US007469840B2

(12) United States Patent
Donnelly et al.

(10) Patent No.: US 7,469,840 B2
(45) Date of Patent: Dec. 30, 2008

(54) CONTROLLER FOR A FUEL FIRED WATER HEATING APPLICATION

(75) Inventors: Donald E. Donnelly, St. Louis, MO (US); G. Scott Vogel, St. Louis, MO (US); Dennis M. Rippelmeyer, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 644 days.

(21) Appl. No.: 11/197,390

(22) Filed: Aug. 4, 2005

(65) Prior Publication Data

US 2007/0028858 A1 Feb. 8, 2007

(51) Int. Cl.
*F23N 1/08* (2006.01)
*G05D 23/00* (2006.01)
*F23D 13/00* (2006.01)

(52) U.S. Cl. ..... 236/20 R; 219/263; 219/497; 122/14.2

(58) Field of Classification Search ..... 236/20 R; 219/263, 497; 122/14.2
See application file for complete search history.

(56) References Cited

U.S. PATENT DOCUMENTS 5,725,368 A 3/1998 Arensmeier ..... 431/66
6,521,869 B1 2/2003 Donnelly et al. ..... 219/263
6,777,653 B2 8/2004 Burkhart ..... 219/497
6,803,544 B1 10/2004 Zikes et al. ..... 219/263
2003/0164368 A1 * 9/2003 Chodacki et al. ..... 219/497

* cited by examiner

*Primary Examiner*—Marc E Norman
(74) *Attorney, Agent, or Firm*—Harness, Dickey & Pierce, P.L.C.

(57) ABSTRACT

A controller is provided for controlling the operation of a gas-fired water heating appliance. In one embodiment of the present invention, a controller is provided that comprises a switching means for connecting an electrical power source to an igniter for igniting gas, a voltage sensing means for sensing the voltage value of the electrical power source, and a processor that is capable of determining whether the power source is of a first rated voltage level or a second rated voltage level. The processor is capable of responsively selecting an appropriate switching sequence from a look-up table having a plurality of switching sequences corresponding to a plurality of voltage values for either the first rated voltage or the second rated voltage, where the processor controls the switching means based on the selected switching sequence to effect switching of power to supply an average predetermined voltage to the igniter that will heat the igniter to a desired temperature.

18 Claims, 2 Drawing Sheets

CONTROLLER FOR A FUEL FIRED WATER HEATING APPLICATION

FIELD OF THE INVENTION

This invention relates to controllers for gas fired heaters, and more particularly to controllers for either 120 volt or 240 volt gas fired water heater applications.

BACKGROUND OF THE INVENTION

Gas fired water heating appliances such as a pool water heater typically have a controller for controlling the supply of gas and an igniter for igniting the gas. An igniter known in the art that is capable of warming up quickly is a silicon nitride hot surface igniter. While such an igniter is desirable because of its mechanical strength and durability, it has a critical temperature limitation which must be avoided. Specifically the silicon nitride igniter must remain below approximately 1350° Celsius. If the igniter temperature repeatedly approaches 1350° C., the igniter will cease to ignite prematurely. Thus, electrical power to the igniter must be controlled to provide an igniter temperature that is sufficient to ignite gas and is below the 1350° C. temperature limitation.

Gas fired water heaters for pools typically require either a 120 volt or 240 volt alternating current power source for pump motors and other components. Controllers for such pool water heaters therefore had to be configured in either a 120 volt or 240 volt embodiment, for controlling the application of power to related components such as an igniter. This is particularly the case with the silicon nitride hot surface igniter, which requires careful control of power applied to the igniter to avoid its critical temperature. Such controllers are typically required to switch power to the igniter to provide an averaged applied voltage of a predetermined level from the line voltage power source. Therefore, the line voltage level of an existing pool water heater that is to be replaced is significant to the selection of the replacement water heater controller.

SUMMARY OF THE INVENTION

The present invention relates to a controller for controlling the operation of a gas-fired water heating appliance. In one embodiment of the present invention, a controller is provided that comprises a switching means for connecting an electrical power source to an igniter for igniting gas, a voltage sensing means for sensing the voltage value of the electrical power source, and a processor that is capable of determining whether the power source is of a first rated voltage level or a second rated voltage level. The processor is capable of responsively selecting an appropriate switching sequence from a look-up table having a plurality of switching sequences corresponding to a plurality of voltage values for either the first rated voltage or the second rated voltage, where the processor controls the switching means based on the selected switching sequence to effect switching of power to supply an average predetermined voltage to the igniter that will heat the igniter to a desired temperature.

The controller further comprises means for determining whether the electrical power source is of a first or second rated voltage level through one of either an Analog-to-Digital input to the processor for sensing the voltage level of the power source, a voltage comparator circuit that provides a voltage level signal to the processor, or a voltage detection circuit for sensing the connection of either voltage source.

Further areas of applicability of the present invention will become apparent from the detailed description provided hereinafter. It should be understood that the detailed description and specific examples, while indicating embodiments of the invention, are intended for purposes of illustration only and are not intended to limit the scope of the invention.

DETAILED DESCRIPTION OF THE INVENTION

Figure 1:
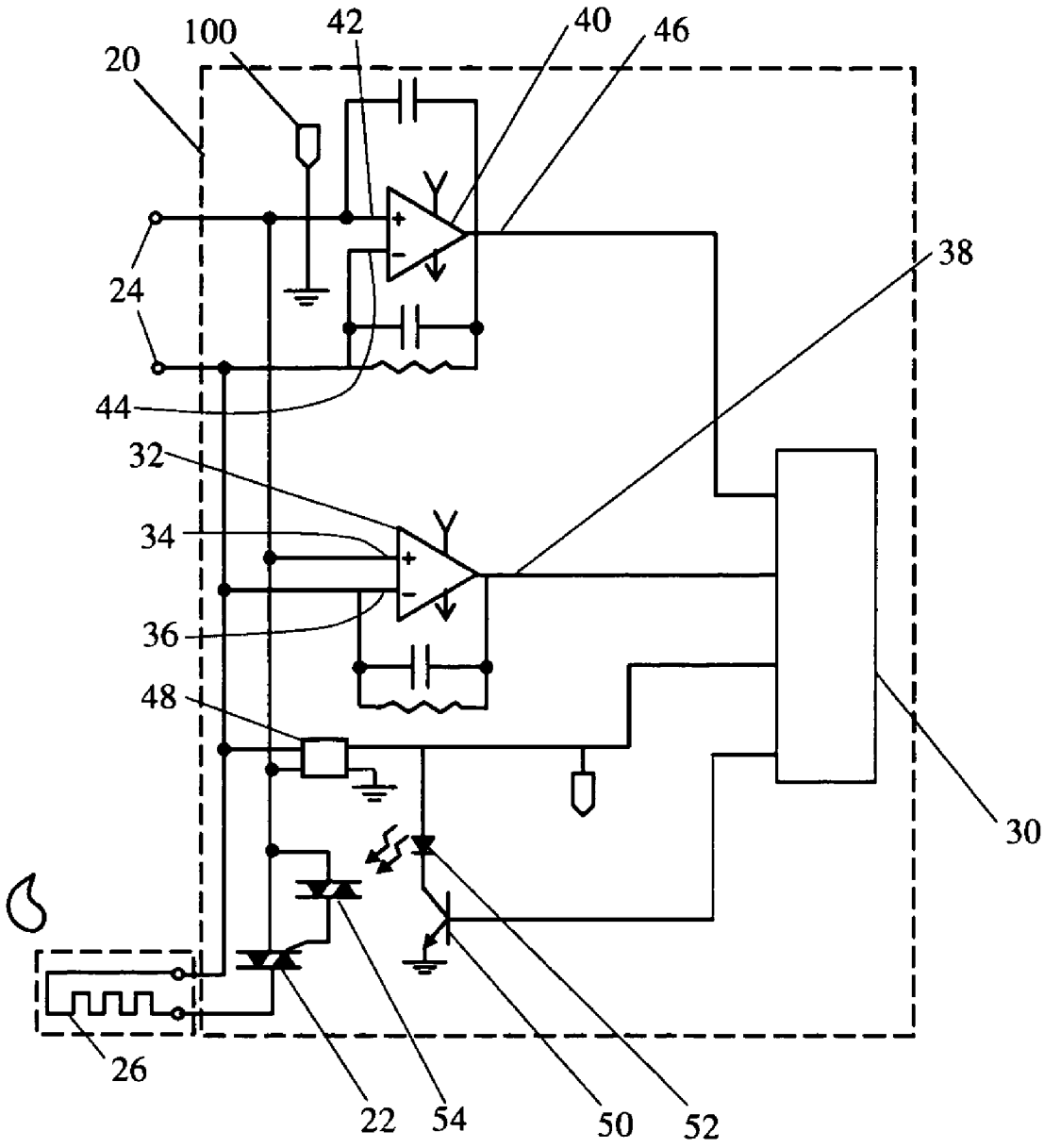
FIG. 1 is a schematic diagram of an embodiment according to the principles of the present invention.

One embodiment of a controller for a gas-fired water heater appliance in accordance with the principles of the present invention is indicated generally as 20 in FIG. 1. The controller 20 comprises a switching means 22 for connecting an electrical power source 24 to an igniter 26 for igniting gas, a voltage sensing means for sensing the voltage value of the electrical power source 24, and a processor 30 that is capable of determining whether the power source 24 is of a first rated voltage level or a second rated voltage level. The processor 30 is capable of responsively selecting an appropriate switching sequence from a look-up table having a plurality of switching sequences corresponding to a plurality of voltage values for either the first rated voltage or the second rated voltage, where the processor 30 controls the switching means 22 based on the selected switching sequence to effect switching of power to supply an average predetermined voltage to the igniter 26 that will heat the igniter 26 to a desired temperature. The processor 30 preferably includes a look-up table stored in a memory of the processor 30, and includes a series of switching sequences comprising on and off duty cycles of half-wave periods of an alternating current source. For example, the switching sequence could comprise a conductive "on" state during a half wave period of an alternating current waveform, followed by an "off" period during the following half-wave period of an alternating current waveform. In this example, the duty cycle would be 50 percent on and 50 percent off. In the preferred embodiment, the look-up table includes a plurality of duty cycles of half-wave periods, which preferably provides for intermittently conducting line voltage from 24 to the igniter 26 to provide an averaged voltage to an igniter over the total period of switching power to the igniter 26. The silicon nitride hot surface igniter 26 powered by the controller 20 of the present invention preferably provides an averaged voltage of about 98 to 102 volts to the igniter, which is sufficient to maintain the temperature of the igniter in the range of about 1150° C. to about 1350° C.

The controller 20 comprises a non-linear op amp 32 configured as a comparator circuit, for comparing the line voltage from terminals 24 to determine whether the power source is of either a first rated voltage or a second rated voltage. Specifically, the line voltage connection at terminals 24 may be input to a non-linear Op-amp, which provides an input to the plus pin 34 and an input to the minus pin 36 of the comparator 32. The comparator circuit provides an output at 38 to the processor 30, which determines whether the power source is of either a first rated voltage or a second rated voltage based on the output signal at 38. The processor 30 may then determine which look up table to use in selecting a switching sequence, which will control switching of power to the igniter 26 based on the actual line voltage value.

The controller further comprises a second non-linear op amp 40 configured as a comparator circuit, for comparing a reference voltage at plus pin 42 to a representative fraction of the line voltage value at minus pin 44, for determining the actual value of either the first rated voltage or the second rated voltage. The output signal of the op amp 40 is a sine wave that varies in amplitude, and may be input to the processor for evaluation. In the preferred embodiment of the present invention, the arrangement of the non-linear op amp 40 is preferably configured to sense a 1/100 fractional portion of the line voltage value and compare the fractional amount to a 5 volt direct current reference, where the output signal may be input to an Analog-to-Digital converter in the processor 30 such that digital values are established for the actual voltage at a resolution of at least two percent of the line voltage. Thus, for every two percent change in actual line voltage value, the processor 30 would be capable of correspondingly select a different switching sequence to apply pulsed power to the igniter 26 at a desired averaged voltage.

The controller 20 further comprises a switching means 22 for switching line voltage to the hot surface igniter 26. The switching means 22 may comprise a single triac that can be gated to conduct either positive or negative voltage. The switching means 22 could also comprise first and second SCR's, wherein the first provides for switching one direction of an alternating current source and the second provides for switch the opposite direction of an alternating current source. The processor 30 controls the switching of a transistor 50 for switching low voltage power from a power supply 48 to a light emitting diode 52, which may be part of an opto-isolator or other similar switching component. For example, the triac 54 and LED 52 may be a single phot-gating component. By controlling the switching of a transistor 50, the processor 30 is capable of controlling the switching means 22 to either effect continuous conduction through the switching means 22 to supply continuous alternating current to the igniter during warm up, or to effect periodic intermittent conduction through the switching means 22 to supply intermittent alternating current to the igniter. Specifically, the processor 30 controls intermittent switching of power to the igniter 26 by using an appropriate switching sequence, having a series of on and off half-wave periods of an alternating current source. Each switching sequence corresponding to a given voltage value comprises a duty cycle of on and off half wave periods of an alternating current source, where the duty cycle of intermittent voltage application to the igniter provides a desired averaged voltage or RMS voltage to the igniter. Thus, for any actual voltage value for either the first rated voltage or the second rated voltage, the processor may select a switching sequence having a duty cycle that will provide a predetermined voltage to the igniter 26 that will heat the igniter 26 to a desired temperature.

Figure 2:
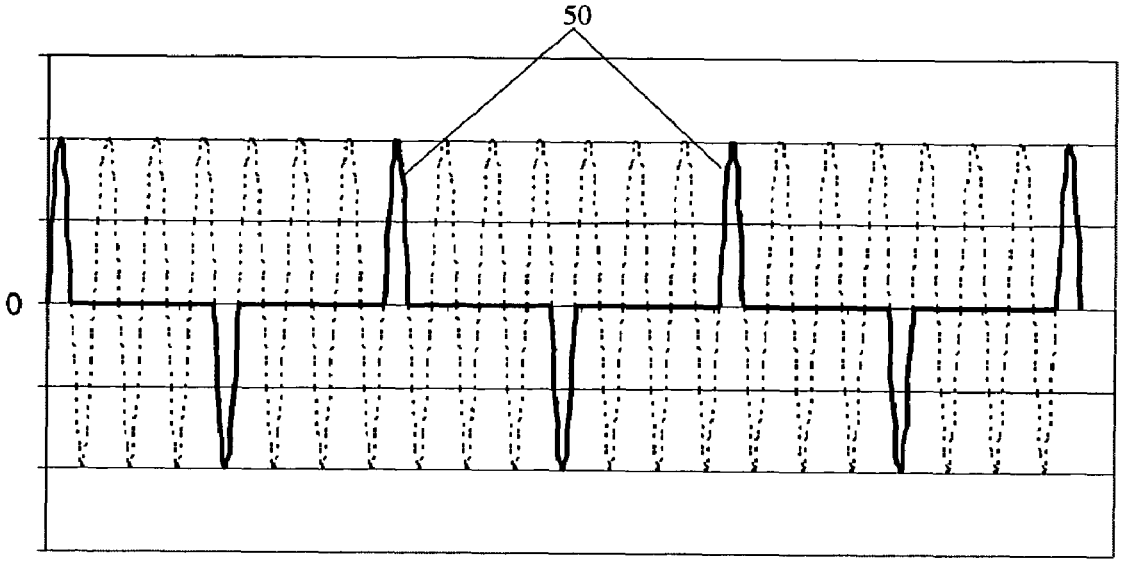
FIG. 2 is an illustration of a switching sequence in accordance with the principles of the present invention.

An example of a switching sequence having a duty cycle of on and off half wave periods of an alternating current source is illustrated in FIG. 2. The switching sequence shown corresponds to an actual voltage value of 240 volts (alternating current), and is selected from a look-up table corresponding to the second rated voltage. The switching sequence has about three full wave cycles between half wave on pulses 50, and provides a pulsed voltage output to the igniter 26 of a predetermined level. In the preferred embodiment of the present invention, the predetermined voltage to the igniter 26 is preferably in the range of about 98 volts to 102 volts. The application of an averaged voltage in this range to the hot surface silicon nitride igniter 26 will heat the igniter to a desired temperature in the range of about 1200° C. to about 1350° C., which is sufficient for igniting gas and also below the critical temperature for this type of igniter. If the line voltage value drops by about two percent, the processor 30 will select another switching sequence that will add more pulses to maintain the predetermined voltage to the igniter 26. While the preferred embodiment comprises the above switching sequence for controlling the application of voltage to an igniter, it should be understood that this illustration is exemplary in nature and the scope of the invention should not be limited to the switching sequence method shown in the above example.

In operation, the processor 30 determines whether the power source 24 is of either a first rated voltage of 120 volts or a second rated voltage of 240 volts (alternating current), and also determines the actual peak line voltage value of the alternating current waveform. From the actual voltage value determined via the input signal at 46 to the processor 30, the processor 30 looks up an appropriate switching sequence from either a first look-up table corresponding to the first rated voltage or a second look-up table corresponding to the second rated voltage. In the preferred embodiment, the first look-up table is for a rated voltage of 120 vac, and the second look-up table is for a rated voltage of 240 vac. From the first or second table, the processor 30 selects an appropriate switching sequence from a plurality of switching sequences corresponding to a plurality of voltage values, where the selected switching sequence corresponds to the actual line voltage value determined by the processor 30. The processor 30 is capable of responsively selecting an appropriate switching sequence from a look-up table having a plurality of switching sequences corresponding to a plurality of voltage values for either the first rated voltage or the second rated voltage, where the processor 30 controls the switching means 22 based on the selected switching sequence to effect switching of power to supply an average predetermined voltage to the igniter 26 that will heat the igniter 26 to a desired temperature. By intermittently switching line voltage to the igniter at a predetermined duty cycle, the controller 20 provides a predetermined averaged voltage to the igniter that will heat the igniter to a desired temperature.

The preferred embodiment of the present invention may also be capable of determining polarity and voltages that are not compatible with the controller 20, such as a three phase power source. If such a power source is connected to the controller 20, the processor will establish a lock-out of igniter and water heater operation. Likewise, the processor 30 may determine a disagreement between the comparator output signal 38 representing a first or second rated voltage and the comparator output signal 46 representative of the actual voltage level, to provide a redundant measurement and accordingly lock out operation of the water heater when not in agreement.

The advantages of the above described embodiment and improvements should be readily apparent to one skilled in the art, as to enabling control of application of either a first or second rated power source to an igniter for a gas fired water heater. Additional design considerations may be incorporated without departing from the spirit and scope of the invention. Accordingly, it is not intended that the invention be limited by the particular embodiment or form described above, but by the appended claims.

What is claimed is:

1. A controller for controlling the operation of a gas-fired water heating appliance, the controller comprising:

a switching means for connecting an electrical power source to an igniter for igniting gas;

a voltage sensing means for sensing the voltage value of the electrical power source, the voltage sensing means comprising a first voltage comparator that provides an output representative of the voltage level of the power source, and also a second voltage comparator that provides an output representative of the voltage level of the power source; and a control means comprising a microprocessor having first and second analog-to-digital inputs connected to the first voltage comparator and second voltage comparator, wherein the microprocessor determines the actual voltage level of the power source for determining whether the power source is of a first rated voltage level or a second rated voltage level, and responsively determines a switching sequence corresponding to either the first rated voltage or the second rated voltage, where the microprocessor controls the switching means based on the switching sequence to effect switching of power to supply an average predetermined voltage to the igniter that will heat the igniter to a desired temperature, and where the microprocessor locks out igniter operation when there is a disagreement between the voltage levels sensed by the first and second voltage comparators.

2. The controller according to claim 1 where the microprocessor includes a program for controlling the switching means based on a look-up table that provides a plurality of switching sequences corresponding to a plurality of electrical power voltage values.

3. The controller according to claim 2 wherein the look-up table comprises a series of switching sequences comprising on and off duty cycles of half-wave periods of an alternating current source.

4. The controller according to claim 3 wherein the switching means comprises first and second triacs.

5. The controller according to claim 4 wherein the first triac provides for switching one direction of an alternating current source and a second triac provides for switch the opposite direction of an alternating current source, and the control means is capable of effecting simultaneous conduction of the first and second triacs to supply continuous alternating current to the igniter during warm up, and is capable of effecting periodic alternating conduction of the first and second triacs to supply intermittent alternating current to the igniter for providing a predetermined averaged voltage to the igniter.

6. The controller according to claim 1, wherein at least one voltage comparator is configured to sense the polarity of the voltage of the power source, wherein the microprocessor locks out igniter operation upon determining that the polarity of the voltage of the power source is not compatible with the controller.

7. A controller for controlling the operation of a gas-fired water heating appliance, the controller comprising:

a switching means for connecting an electrical power source to an igniter for igniting gas;

a voltage sensing means for sensing the voltage value of the electrical power source, the voltage sensing means comprising a first voltage comparator that provides an output representative of the voltage level of the power source, and also a second voltage comparator that provides an output representative of the vo1tage level of the power source; and a microprocessor having first and second analog-to-digital inputs connected to the first voltage comparator and second voltage comparator, wherein the microprocessor determines the actual voltage level of the power source to determine whether the power source is of a first rated voltage level or a second rated voltage level and responsively selects an appropriate switching sequence from a look-up table having a plurality of switching sequences corresponding to a plurality of voltage values for either the first rated voltage or the second rated voltage, where the microprocessor controls the switching means based on the selected switching sequence to effect switching of power to supply an average predetermined voltage to the igniter that will heat the igniter to a desired temperature, and where the microprocessor locks out igniter operation when there is a disagreement between the voltage levels sensed by the first and second voltage comparators.

8. The controller according to claim 7 wherein the look-up table includes a series of switching sequences comprising on and off duty cycles of half-wave periods of an alternating current source.

9. The controller according to claim 8 wherein the switching means comprises first and second triacs.

10. The controller according to claim 9 wherein the first triac provides for switching one direction of an alternating current source and a second triac provides for switch the opposite direction of an alternating current source, and the control means is capable of effecting simultaneous conduction of the first and second triacs to supply continuous alternating current to the igniter during warm up, and is capable of effecting periodic alternating conduction of the first and second triacs to supply intermittent alternating current to the igniter for providing a predetermined averaged voltage to the igniter.

11. The controller according to claim 9 wherein the controller comprises at least first and second terminals for connecting the controller to either a 120 volt current voltage source or a 240 volt alternating current source.

12. The controller according to claim 8, wherein the microprocessor selects a switching sequence from either a first look-up table corresponding to a 120 volt power source or a second look-up table corresponding to a 240 volt power source, where the switching sequence comprises an on and off duty cycle that provides an averaged predetermined voltage to the igniter for heating the igniter to a desired temperature.

13. The controller according to claim 12, wherein the predetermined voltage is in the range of about 98 volts to 102 volts.

14. The controller according to claim 13, wherein the desired temperature is in the range of about 1100° to about 1300° Celsius.

15. The controller according to claim 7 wherein the first voltage comparator for determining whether the electrical power source is of a first or second rated voltage level further comprises a first connection to a first terminal for a 120 volt alternating current source and a second connection to a second terminal for a 240 volt alternating current source, and wherein the first voltage comparator detects the level of voltage in either the first connection to the first terminal or the second connection to the second terminal.

16. The controller according to claim 7, wherein at least one voltage comparator is configured to sense the polarity of the voltage of the power source, wherein the microprocessor locks out igniter operation upon determining that the polarity of the voltage of the power source is not compatible with the controller.

17. A method for controlling the operation of a gas-fired water heating appliance having a voltage level sensing means, a switching means, and a microprocessor in communication with the voltage sensing and switching means, the method comprising:

sensing the voltage level of the electrical power source connected to the controller using a first voltage comparator that provides an output representative of the voltage level of the power source, and also a second voltage comparator that provides an output representative of the voltage level of the power source;

locking out igniter operation when there is a disagreement between the voltage levels sensed by the first and second voltage comparators;

determining whether the power source is either a 120 volt alternating current source or a 240 volt alternating current source;

selecting an appropriate switching sequence from either a first look-up table for a 120 volt power source having a plurality of switching sequences corresponding to a plurality of sensed voltage values, or a second look-up table for a 240 volt power source having a plurality of switching sequences corresponding to a plurality of sensed voltage values, where the switching sequence comprises an on and off duty cycle of half-wave periods of an alternating current; and controlling the switching means based on the selected duty cycle to provide an average predetermined power to the igniter to heat the igniter to a desired temperature.

18. The method of claim 17 further comprising the step of comparing a reference voltage to a predetermined voltage for determining whether the power source is either a 120 volt or 240 volt power source.

* * * * *